United States Patent [19]

Ritzerfeld

[11] 4,037,531

[45] July 26, 1977

[54] ROTARY PRINTING MACHINE

[76] Inventor: Gerhard Ritzerfeld, Schorlemer Allee 14, 1000 Berlin 33, Germany

[21] Appl. No.: 601,933

[22] Filed: Aug. 4, 1975

[30] Foreign Application Priority Data

Aug. 8, 1974 Germany ..... 2438420

[51] Int. Cl.[2] ..... B41L 47/46

[52] U.S. Cl. ..... 101/91; 101/132.5

[58] Field of Search ..... 101/91, 132.5, 140, 101/141, 143, 144, 145, 218, 232, 233, 234, 235, 247

[56] References Cited

U.S. PATENT DOCUMENTS

| | | | |
|---|---|---|---|
| 3,016,825 | 1/1962 | Ritzerfeld et al. | 101/234 |
| 3,037,447 | 6/1962 | Gonzalez et al. | 101/91 |
| 3,077,832 | 2/1963 | Ritzerfeld et al. | 101/132.5 |
| 3,155,036 | 11/1964 | Ritzerfeld et al. | 101/91 X |
| 3,217,639 | 11/1965 | Kelly | 101/233 |
| 3,283,706 | 11/1966 | Ritzerfeld | 101/91 X |
| 3,815,497 | 6/1974 | Wallace | 101/232 |

*Primary Examiner*—Edward M. Coven
*Attorney, Agent, or Firm*—Michael J. Striker

[57] ABSTRACT

The printing machine includes a cyclically moving printing member having a printing surface, particularly a rotating printing roller carrying a lithographic printing form, and an inking arrangement for inking the printing surface. A counterpressure member is mounted for movement into an operative position in which it presses towards the inked printing surface so as to press an item to be printed against the inked printing surface. A feeding arrangement feeds an item to be printed into the space intermediate the printing surface and the counterpressure member. A synchronizing arrangement is coupleable to the cyclically moving printing member by a controllable coupling device so as to be driven by the cyclically moving printing member. When so coupled and driven, it is operative for causing the counterpressure member to move into operative position in synchronization with the movement of the printing member. A control arrangement controls the controllable coupling device and accordingly the driving connection between the cyclically moving printing member and the synchronizing arrangement in dependence upon the actual feeding of the item to be printed.

4 Claims, 2 Drawing Figures

ROTARY PRINTING MACHINE

BACKGROUND OF THE INVENTION

The invention relates to printing machines of the type comprised of a cyclically moving printing member, and particularly to lithograph machines of the type comprised of a rotating printing drum carrying a lithographic printing form, and inking means for inking the printing surface. Such machines are operative for printing page-wise, paragraph-wise or linewise onto tickets, cards, or other items to be printed. Conventionally, such machines are provided with synchronizing means for establishing a synchronization between the movement of a counterpressure member into operative position and the aforementioned cyclical movement of the printing member. In its operative position, the counterpressure member presses towards the inked surface, so as to press an item to be printed against the inked printing surface.

When printing off of lithographic printing forms onto cards, labels, and the like, it can happen that the item to be printed is not fed into the printing machine, for example as a result of malfunction of the feeding arrangement. If this occurs, the counterpressure member may be pressed into contact against the inked printing surface of the printing form and become covered with ink. As a result, when an item to be printed is subsequently fed into the printing machine, the ink image on the counter-pressure member undesirably will be transferred onto the back side of the item to be printed.

SUMMARY OF THE INVENTION

It is accordingly an object of the present invention to provide a printing machine of the type in question in which non-feed of an item to be printed does not result in transfer of the ink image from the inked printing surface of the cyclically moving printing member to the aforementioned counterpressure member.

This object, and others which will become more understandable from the description, below, of a preferred embodiment, can be met, according to one advantageous concept of the invention, by controlling the coupling between the cyclically moving printing member and the synchronizing means in dependence upon the feeding into the printing machine of items to be printed.

According to one advantageous concept of the invention, the synchronizing means is mechanically coupled to the cyclically moving printing member, e.g., rotating printing drum or other structure, by means of a controllable clutch. A sensing device senses the presence of an item to be printed as such item is fed into the printing machine. A control device is operative in response to the detection of such an item for engaging the clutch at the start of a cycle of movement of the printing member and then disengaging the clutch at the end of the cycle. The synchronizing means can comprise one or more rotating cam disks or rotating switch means for controlling the energization of electromagnets which move the counterpressure member from one to the other of its positions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
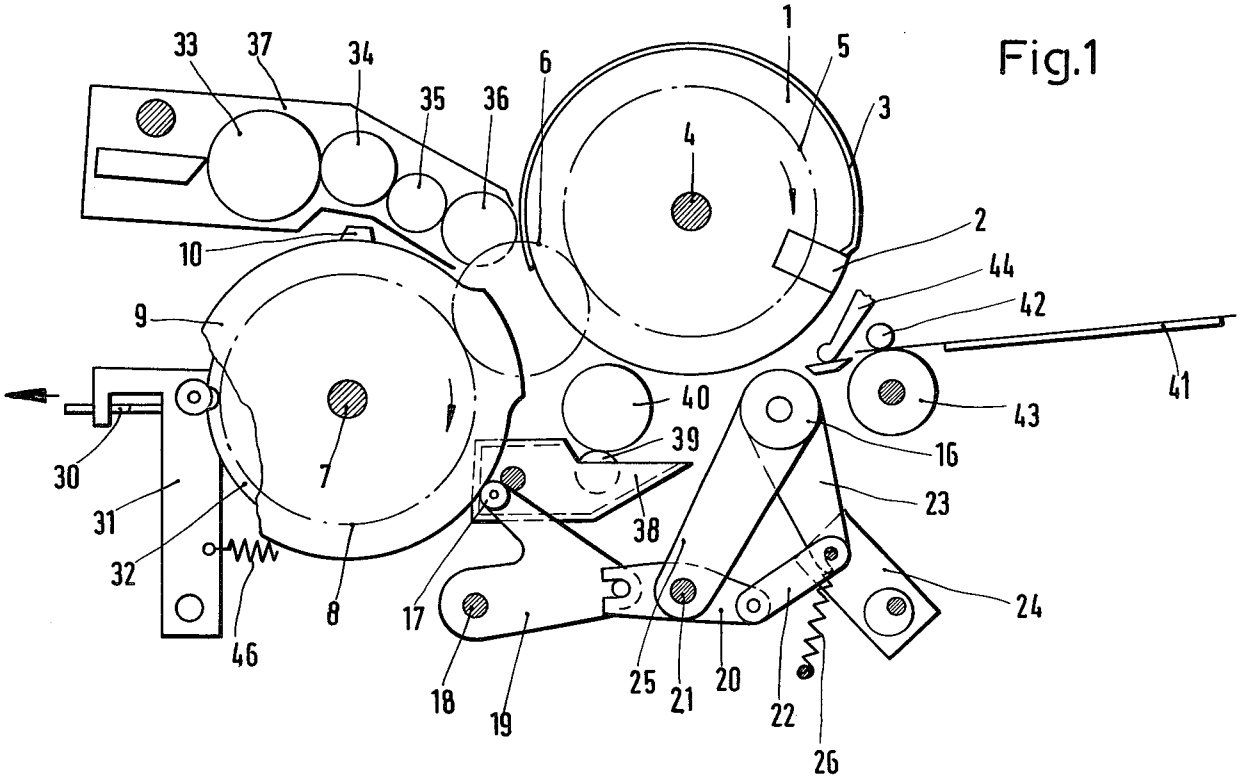
FIG. 1 is a simplified schematic side view of a rotary lithographic duplicator machine.

A holding arrangement 2 fixedly secures a lithographic printing form 3 on the surface of a printing drum 1. The printing drum 1 is rotatably mounted on a shaft 4 and is driven by a (non-illustrated) prime mover one rotation at a time. Rotating with the printing drum 1 is a gear 5 which, through the intermediary of a gear 6, drives a gear 8 which is mounted on a shaft 7 for rotary movement relative to shaft 7.

Fixedly mounted on the shaft 7, for rotation therewith, are synchronzing cams 9–15. These synchronizing cams, in per se known manner, cause a counterpressure roller 16 to be swung against the printing drum 1 at proper times during the printing cycle. This makes possible pagewise, paragraphwise or linewise printing, as desired. To this end, the cam surfaces of the synchronizing cams 9–15 are engaged by a cam-follower roller 17 provided at the end of a cam-follower lever 18 pivotably mounted on a fixed pivot shaft 18. When one of the lobes of the synchronizing cams 9–15 arrives at the cam-follower roller 17, the lobe causes the cam-follower lever 19 to pivot counterclockwise about the pivot shaft 18. This causes a two-armed control lever 21 to pivot counterclockwise, effecting displacement of a linkage member 22. This displacement is transmitted via an elbow-joint lever linkage 23, 24 to a guide lever 25. The lower end of lever 25 is pivoted about shaft 21, whereas its upper end carries the rotatably mounted counterpressure roller 16. Accordingly, the counterpressure roller 16 presses against the printing drum 1. The subsequent swinging of the counterpressure roller 16 away from the printing drum 1 occurs under the action of a return spring 26 which returns the lever arrangement to the illustrated position, after the lobe in question has moved past the cam-follower roller 17. Also the return spring ensures that the cam-follower roller 17 bears reliably upon the cam surfaces of the synchronizing cams 9–15.

The gear 8, while rotatable relative to the shaft 7 on which it is mounted, is connected to and non-rotatable relative to a first clutch half 27. The second clutch half 28, on the other hand, is mounted on the shaft 7 non-rotatable relative to the shaft 7, but slidable axially along the shaft 7. By sliding the second clutch half 28 along the shaft 7, the two clutch halves 27, 28 can be engaged and disengaged.

When the clutch is engaged, the rotary motion of printing drum 1 is transmitted via gears 5, 6 and 8, via the clutch 27, 28 and via the shaft 7 to the synchronizing cams 9–15, so that at the proper times during the printing cycle the counterpressure roller 16 will be moved into and out of operative position, making possible transfer to the item to be printed of selected portions of the image on the inked printing surface of lithographic printing form 3.

In contrast, if the clutch halves 27, 28 are not engaged, then as the printing drum 1 turns, rotary motion will not be transmitted to the synchronizing cams 9–15, and the counterpressure roller 16 will not be moved into its operative position during the printing cycle.

The axial shifting of the clutch half 28 along the shaft 7 is effected by means of a lever 30 pivoted about a shaft 29. If the clutch halves 27, 28 are not engaged, then by means of an arm 31 on the lever 30, an arresting disk 32 fixedly connected to the shaft 7 (i.e., non-rotatable relative to the shaft 7) is held in a position corresponding to the starting position of the synchronizing cams 9–15 at the start or end of a printing drum rotation.

The inking of the lithographic printing form 3 is performed by means of rollers 33–36 of an inking arrangement 37. This inking arrangement can be swung in per se known manner into engagement with the printing surface of form 3 during different printing operations. Additionally, the rotary lithographic printing machine includes a water tank 38 and a dampening arrangement including two dampening rollers 39, 40 which, likewise, in per se known manner can be swung into engagement with the printing surface. By appropriately controlling the inking arrangement and the dampening arrangement, the printing surface of the lithographic printing form 3 will be dampened and inked at the proper times during the printing cycle, in per se conventional manner.

After the first inking of the printing form 3, which is performed with the clutch halves 27, 28 disengaged, tickets, cards, or other items to be printed, are fed via a feed table 41 and feeding rollers 42, 43 into the space between the printing drum 1 and the counterpressure roller 16.

Located in the path of infeed travel of the items to be printed is a sensor 44 which when tripped by an item to be printed, as the item is fed into the machine, effects energization of an electromagnet 45, by means of a non-illustrated switch, power supply and connecting conductors. The energization of electromagnet 45 causes the lever 30 to pivot in a sense causing the clutch halves 27, 28 to become engaged. Accordingly, the synchronzing cams 9–15, during the next-following printing drum rotation, do rotate in synchronism with the printing drum, so that the counterpressure roller 16 will be moved into operative position at the desired times within the printing cycle.

Figure 2:
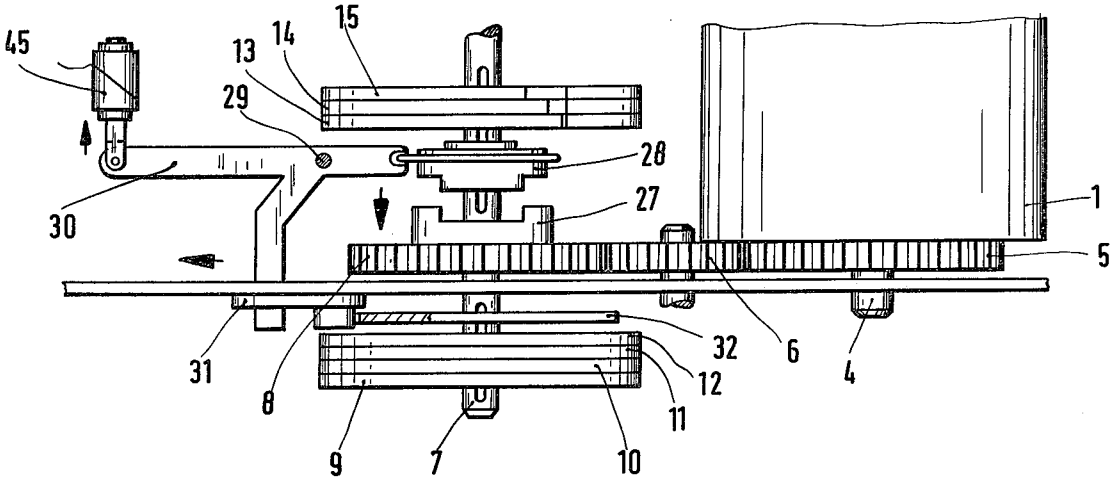
FIG. 2 is a top view of a part of the machine of FIG. 1, showing in particular the synchronizing arrangement.

At the end of each printing drum rotation, the electromagnet 45 is automatically deenergized, so that the lever 30, by means of a return spring 46, is drawn back to the position illustrated in FIG. 2, so as to guarantee that the counterpressure roller 16 moves into operative position only when an item to be printed is actually present in the space intermediate counterpressure roller 16 and the printing drum 1. The automatic deenergization of the electromagnet 45 at the end of each printing drum rotation can be effected in any convenient manner. For example, the current path of the electromagnet 45 could include, besides the non-illustrated power supply (e.g., a battery) and the series-connected switch closed by the sensor 44, a relay switch which closes when electromagnet 45 becomes energized, to provide a self-locking action. A further switch, also connected in the current path of electromagnet 45, could be provided and be tripped briefly open at the end of the printing drum rotation by a trip mounted on the printing drum 1, to terminate the self-locking action and thereby effect the aforementioned automatic deenergization of electromagnet 45 at the end of each printing drum rotation.

Instead of cams, the synchronizing means could be comprised of switch elements for closing electric switches connected in the current paths of electromagnets operative for effecting the movements of the counterpressure roller 16 between its positions. With such expedient, it is preferred that the switching means be comprised of a stationary contact disk provided with a number of electrically conductive strips corresponding to the number of lines on the printing form, and further comprised of a contact arm rotating in synchronism with the printing drum 1. The angular extent of the various arcuate contact strips would correspond to the specific fractions of the printing cycle during which the counterpressure roller 16 is to occupy its operative position. The controllable clutch could be provided intermediate the pivot shaft of the rotating contact arm and the rotating printing drum or the drive for the latter. The clutch would be engaged and disengaged in response to the detection of the presence of an item to be printed as such item is fed into the printing machine. If no item to be printed is detected, then the clutch would remain disengaged, so that the counterpressure roller would not be moved into its operative position during the printing drum rotation.

It will be understood that each of the elements described above, or two or more together, may also find a useful application in other types of constructions differing from the type described above.

While the invention has been illustrated and described as embodied in a rotary lithographic printing machine, it is not intended to be limited to the details shown, since various modifications and structural changes may be made without departing in any way from the spirit of the present invention.

In the illustrated embodiment, the synchronizing cams are coupleable to the prime mover for the printing drum 1 via a gear 5 connected with the drum itself, i.e., down-train of the drum in the power train from the (non-illustrated) prime mover. However, the synchronizing means could also be coupleable to the prime mover uptrain of the drum in the power train. For example, the synchronizing means could be coupled to the output shaft of an electric motor constituting the prime mover, so that the synchronizing means would be driven by the prime mover in synchronism with the printing drum, without actually being driven by the printing drum itself. Both possibilities fall within the scope of the invention, and are intended to be referred to when reference is made to the coupling of the synchronizing means to or with the printing drum, and when reference is made to the driving connection between the printing drum and the synchronizing means.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A printing machine of the type comprised of a cyclically moving printing member having a printing surface comprised of a rotating printing drum carrying a printing and inking means for inking the printing surface, comprising, in combination, a counterpressure member mounted for movement into an operative position in which it presses towards the inked printing surface so as to press an item to be printed against the inked printing surface; feeding means for feeding an item to be printed into the space intermediate the printing surface and said counterpressure member; moving means operative when driven for moving said counterpressure member into said operative position; controllable coupling means; rotary synchronizing means coupleable with the cyclically moving printing member by said controllable coupling means so as to receive rotational drive force from the printing member and be rotated by the latter and operative when so coupled and rotated for effecting transfer to items to be printed of predetermined portions of the ink image on the printing surface by transmitting mechanical drive force from said printing member to said moving means; and control means operative for detecting feeding of an item to be printed and in response to such detection engaging said controllable coupling means and accordingly establishing a driving connection between the cyclically moving printing member and said synchronizing means.

2. A printing machine of the type comprised of a cyclically moving printing member having a printing surface and inking means for inking the printing surface, comprising, in combination, a counterpressure member mounted for movement into an operative position in which it presses towards the inked printing surface so as to press an item to be printed against the inked printing surface; feeding means for feeding an item to be printed into the space intermediate the printing surface and said counterpressure member; moving means activatable for moving said counterpressure member into said operative position; controllable coupling means; synchronizing means coupleable with the cyclically moving printing member by said controllable coupling means so as to be driven with the cyclically moving printing member and operative when so coupled and driven for effecting transfer to items to be printed of predetermined portions of the ink image on the printing surface by activating said moving means in synchronization with the movement of the printing member; and control means operative for detecting feeding of an item to be printed and in response to such detection engaging said controllable coupling means and accordingly establishing a driving connection between the cyclically moving printing member and said synchronizing means, wherein said controllable coupling means is a controllable clutch means for effecting a mechanical coupling between said synchronizing means and the cyclically moving printing member.

3. The printing machine defined in claim 2, wherein said control means comprises sensing means for sensing the presence of an item to be printed as such item is fed by said feeding means, engaging said clutch means at the start of a cycle of movement of the printing member in response to such sensing and disengaging said clutch means at the completion of the cycle of movement.

4. A printing machine of the type comprised of a cyclically moving printing member having a printing surface and inking means for inking the printing surface, comprising, in combination, a counterpressure member mounted for movement into an operative position in which it presses towards the inked printing surface so as to press an item to be printed against the inked printing surface; feeding means for feeding an item to be printed into the space intermediate the printing surface and said counterpressure member; moving means activatable for moving said counterpressure member into said operative position; controllable coupling means synchronizing means coupleable with the cyclically moving printing member by said controllable coupling means so as to be driven with the cyclically moving printing member and operative when so coupled and driven for effecting transfer to items to be printed of predetermined portions of the ink image on the printing surface by activating said moving means in synchronization with the movement of the printing member; and control means operative for detecting feeding of an item to be printed and in response to such detection engaging said controllable coupling means and accordingly establishing a driving connection between the cyclically moving printing member and said synchronizing means, wherein said synchronizing means comprises can means coupleable to the cyclically moving printing member by said controllable coupling means, and wherein said moving means comprises cam follower means displaceable by said cam means to transmit motion to said counterpressure member to move the latter into said operative position.

* * * * *